US006058929A

United States Patent [19]

Fritz

[11] Patent Number: 6,058,929

[45] **Date of Patent: *May 9, 2000**

[54] ADJUSTABLE EXHAUST HOOD WITH AIR CURTAIN

[75] Inventor: Frederick F. Fritz, Stanwood, Mich.

[73] Assignee: Randell Manufacturing, Inc., Weidman, Mich.

[ * ] Notice: This patent is subject to a terminal disclaimer.

[21] Appl. No.: 08/398,380

[22] Filed: Mar. 3, 1995

Related U.S. Application Data

[63] Continuation-in-part of application No. 08/241,727, May 12, 1994, Pat. No. 5,522,377.

[51] Int. Cl.[7] ..... F24C 15/20

[52] U.S. Cl. ..... 126/299 R; 126/299 D; 55/DIG. 36

[58] Field of Search ..... 126/299 R, 299 D, 126/299 C, 307 R, 312, 300–303, 299 E; 454/61, 62, 67; 55/418, DIG. 36

[56] References Cited

U.S. PATENT DOCUMENTS

| | | | |
|---|---|---|---|
| 3,513,766 | 5/1970 | Ahlrich | 126/299 D |
| 4,556,046 | 12/1985 | Rifflel et al. | 126/299 D |
| 4,811,724 | 3/1989 | Aalto et al. | 126/299 D |
| 5,522,377 | 6/1996 | Fritz | 126/299 D |

FOREIGN PATENT DOCUMENTS

| | | | |
|---|---|---|---|
| 63-251740 | 10/1988 | Japan | 126/299 D |
| 3-251631 | 11/1991 | Japan | 126/299 D |
| 3-255836 | 11/1991 | Japan | 126/299 D |

*Primary Examiner*—James C. Yeung
*Attorney, Agent, or Firm*—Rader, Fishman & Grauer PLLC

[57] ABSTRACT

An exhaust hood is disclosed which comprises an open underside and a grease filter defining an exhaust plenum between the hood and the grease filter and a flow path through the grease filter. A shutter-like panel is slidable into the flow path adjacent to the grease filter for blocking a portion of the flow path to adjust the distribution of air across the face of the hood without altering the volume of air flowing through the exhaust hood. Multiple side-by-side panels may be provided and each panel preferably tapers in height across its width. An intake fan is provided at a front portion of the hood to direct room air from adjacent the hood through an intake plenum and downwardly at a front portion of the space beneath the hood to create a partial air curtain which is then exhausted through the hood.

15 Claims, 4 Drawing Sheets

ADJUSTABLE EXHAUST HOOD WITH AIR CURTAIN

Related Applications

This application is a continuation-in-part of U.S. application Ser. No. 08/241,727, filed May 12, 1994, U.S. Pat. No. 5,522,377.

BACKGROUND OF THE INVENTION

1. Field of the Invention

This invention relates to an exhaust hood for removing air laden with grease, smoke or other contaminants from a working environment, and more specifically to such an exhaust hood with mechanisms for adjusting the volume of air passing through the hood and generating an air curtain beneath the hood.

2. Description of Related Art

Exhaust hoods are used in a variety of environments such as kitchens, laboratories and factories for exhausting heated or contaminated air from a working environment. In a restaurant kitchen, for example, there are usually a number of cooking units aligned in a row. Some of these units, broilers and fryers for example, may produce considerable quantities of smoke, fumes, grease particles and moisture, while other units such as ranges and griddles may generate such pollutants in considerably smaller amounts. Kitchen exhaust ventilators have traditionally been designed with enough airflow capacity to remove pollutants from broilers, fryers and other more active pollution-generating cooking units. This results in excessive ventilation for those cooking units which generate less pollution, such as the ranges and griddles.

A typical exhaust hood comprises a housing in the form of a box-like structure with an intake comprising an open underside, and an exhaust duct leading outwardly from its upper side. Air from the kitchen environment passes into the housing through a series of grease filters, and into an exhaust plenum above the grease filters. From the exhaust plenum, it is drawn out of the hood through the exhaust duct. In a kitchen the hoods are typically horizontally elongated to accommodate a row of cooking units.

An elongated hood may give rise to uneven distribution of air across the width of the hood. The portion of the hood directly beneath the exhaust duct tends to remove air at the greatest volume-rate, while portions of the hood displaced from the exhaust duct tend to exhaust air at lower volume-rates. A common solution to this problem is to situate the most active of the pollution-generating cooking units directly beneath the exhaust duct and to place the least active pollution-generating units furthest from the exhaust duct. However, such an arrangement may not promote optimal efficiency of the cooks working at the equipment, and many chefs prefer to experiment with different equipment locations to achieve maximum efficiency within the kitchen To improve the flow distribution across a given exhaust hood, prior designs have incorporated a flow restriction strategically located in the path of the exhaust air to provide a desired flow distribution. For example, U.S. Pat. No. 4,281,635, issued Aug. 4, 1981 to E. C. Gaylord, discloses a kitchen ventilator or exhaust hood mounted over an arrangement of kitchen equipment which includes a broiler, a fryer, a range and a griddle. Air and grease pass from the equipment through an inlet opening and take a circuitous path through a series of opposing horizontal baffles to extract grease and other contaminants. A damper baffle mounted on a horizontal pivot at the inlet opening is pivotable toward and away from the lowest baffle to vary the width of a gap between the damper and the baffle, whereby to vary the volume of air flowing past the damper. To accommodate the varying exhaust requirements of different pieces of kitchen equipment, additional baffling is provided to reduce the rate of air flow into portions of the ventilator positioned above the range and griddle units. The additional baffling comprises choke plates attached to the hood in strategic locations and extending into the path of the exhaust air passing through the grease baffles. Several of the choke plates are bolted in place and others are spot-welded in place. To rearrange equipment beneath the exhaust hood, the choke plates must be removed and repositioned. To remove those choke plates which are spot-welded, the welds must be burned off The volume of air exhausted through the hood must be replenished from some source. If exterior air is drawn into the kitchen area, it is typically tempered, particularly in northern climes. Such systems require additional energy expenditures. It is also known to draw air (often called "make-up" air) from adjacent rooms in restaurants, for example, but such systems require additional ducting and sometimes result in uneven air distribution from room to room.

Sometimes air curtains are generated across the front of a hood to "seal" smoke and grease-laden air beneath the hood and prevent it from entering the kitchen area. Many such air curtains are generated by structure mounted to the front of a hood and obtain source air from the exterior of a building, or from make-up air. Both sources require costly installations of extra ductwork.

SUMMARY OF THE INVENTION

The exhaust hood of the present invention provides a simpler and more effective solution to the problem of the requirement for varied exhaust air flow across an exhaust hood to accommodate the requirements of various arrangements of equipment, each having different exhaust output, beneath the hood. The exhaust hood of the present invention further provides a sufficient air curtain to trap exhaust gases within the exhaust hood, without the need for extensive additional duct installation or introduction of untempered outside air.

The invention provides an exhaust hood in which a housing and a grease filter cooperate to define an exhaust plenum with an exhaust air flow path through the grease filter, and a shutter panel slidable into the flow path, adjacent to the grease filter, to block a portion of the flow path and thereby adjust the volume of air flowing through the exhaust hood. The height of the shutter panel varies between its ends, whereby the volume of air flow through the exhaust hood varies across the width of the exhaust hood.

The invention further provides that the hood comprises a second plenum, located toward the front of the hood, with a diffused opening facing downwardly at the front of the hood, and a second opening in communication with the space adjacent the hood, within the room where the hood is located. A fan is disposed in the hood in a position to draw air into the second plenum, through the second opening, and force it out through the diffused opening. The air which is forced out through the diffused opening forms at least a partial air curtain, proximate to the lower edge of the exhaust hood, and adjacent to its open underside. This air curtain is sufficient to trap the flow of rising exhaust air, which is warm and laden with smoke and grease, within the exhaust hood.

Other features and advantages of the invention will be apparent from the ensuing description in conjunction with the accompanying drawings.

DESCRIPTION

Figure 1:
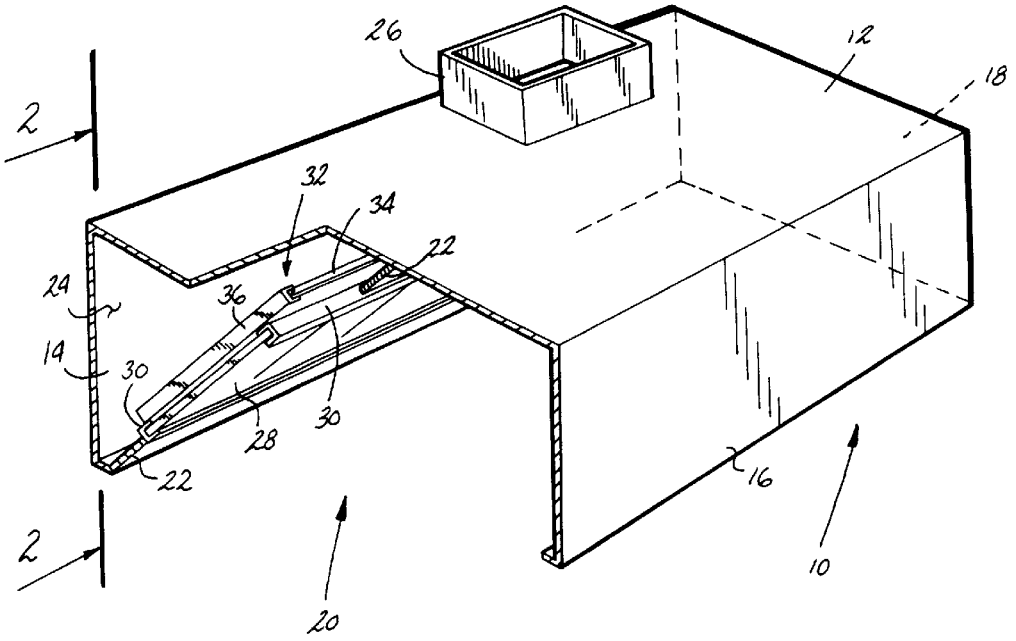
FIG. 1 is a partial sectional perspective view of an exhaust hood according to the invention.

Referring now to the drawings and to FIG. 1 in particular, an exhaust hood 10 is shown which includes a housing comprising upper rear front and side panels 12, 14, 16 and 18 forming a generally rectangular box-like structure having an open underside 20. A dividing wall 22 slopes from a rear portion of the underside 20 upwardly and forwardly towards the top panel 12 to define an exhaust plenum 24 within the exhaust hood 10 above the dividing wall 22. An exhaust duct 26 extends upwardly and outwardly from the exhaust plenum 24 through the top panel 12. Suction applied to the exhaust duct 26, as by an exhaust fan (not shown), draws air from the exhaust plenum 24 out of the exhaust hood 10 through the exhaust duct 26.

A portion of the dividing wall 22 comprises a grease filter 28 of a type ordinarily used in the art. Typically, an exhaust hood such as the hood 10 will have several grease filters 28 arranged in side-by-side arrangement to span the full width of the exhaust hood. The grease filters 28 are mounted in upper and lower U-shaped horizontally disposed channels 30 in the ordinary fashion.

Figure 2:
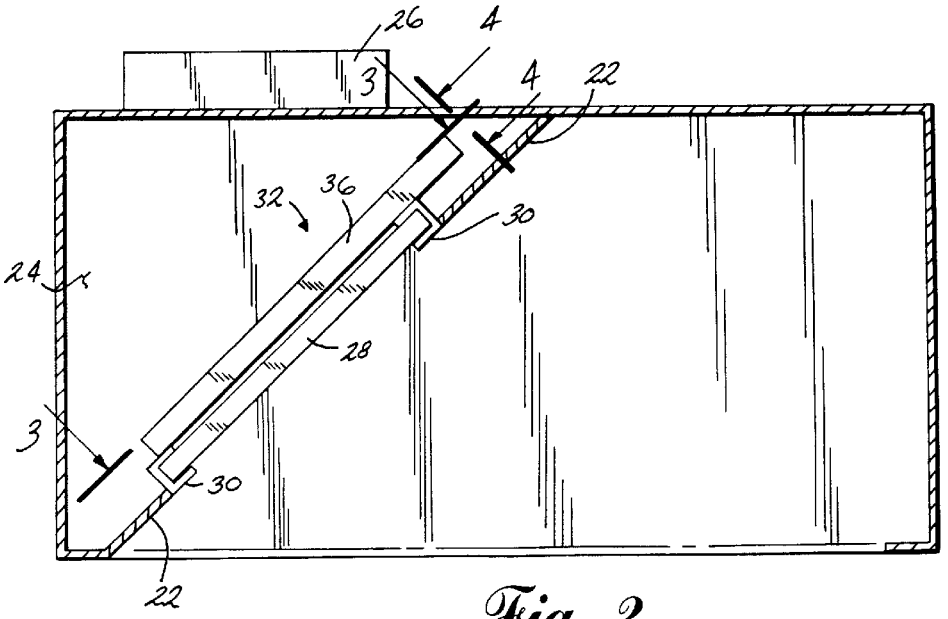
FIG. 2 is a side elevational view in cross-section of the exhaust hood of FIG. 1 taken along line 2—2 of FIG. 1.

Turning to FIG. 2, the grease filters 28 thus slope upwardly and forwardly at an approximately 45° angle. A flow adjusting mechanism 32 is disposed immediately behind the grease filters 28. The flow adjusting mechanism 32 comprises one or more shutter-like panels 34 slidably mounted behind and parallel to the grease filters 28. Preferably, a pair of elongated U-shaped channels 36 are provided for slidably receiving the panel 34. The panel 34 slides within the channels 36 parallel to the grease filters 28 to selectively cover and uncover portions of the grease filters 28 and thereby adjust the quantity of air flowing through the hood. Preferably, the components of the flow adjusting mechanism 32 are formed of stainless steel or aluminized steel Turning to FIG. 3, it can be seen that the panel has the shape of an elongated, truncated right triangle providing a first end 38 (corresponding to the base of the triangle) and a second end 40 (corresponding to a truncated edge of the triangle). An upper edge of the panel 42 is essentially horizontal, while a lower edge 44 slopes slightly upwardly toward the panel second end 40. Preferably, the height of the panel 34 (distance between the upper and lower edges 42 and 44) at the first end 38 will be approximately twice the height at the second end 40. Thus, the panel first end 38 blocks a larger portion of the grease filters 28 than the panel second end 40 and provides for a correspondingly larger volume of air passing through the grease filter 28 adjacent to the panel second end 40.

Figure 4:
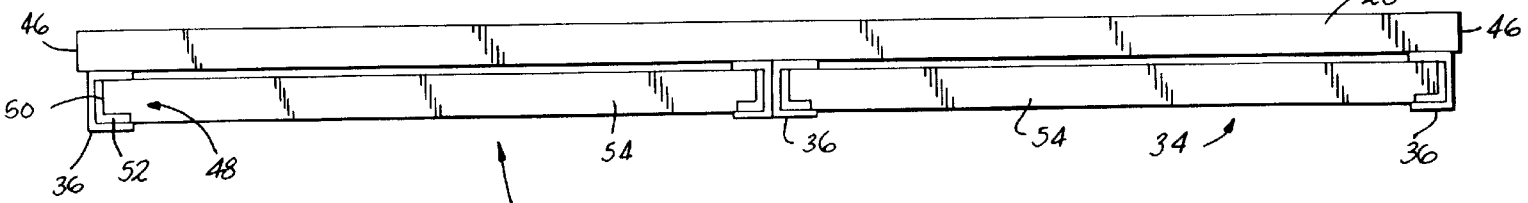
FIG. 4 is a sectional view of a portion of the hood of FIG. 1 taken along line 4—4 of FIG. 2 and illustrating a mounting arrangement for the adjustable flow restriction panel of FIG. 3.
Figure 5:
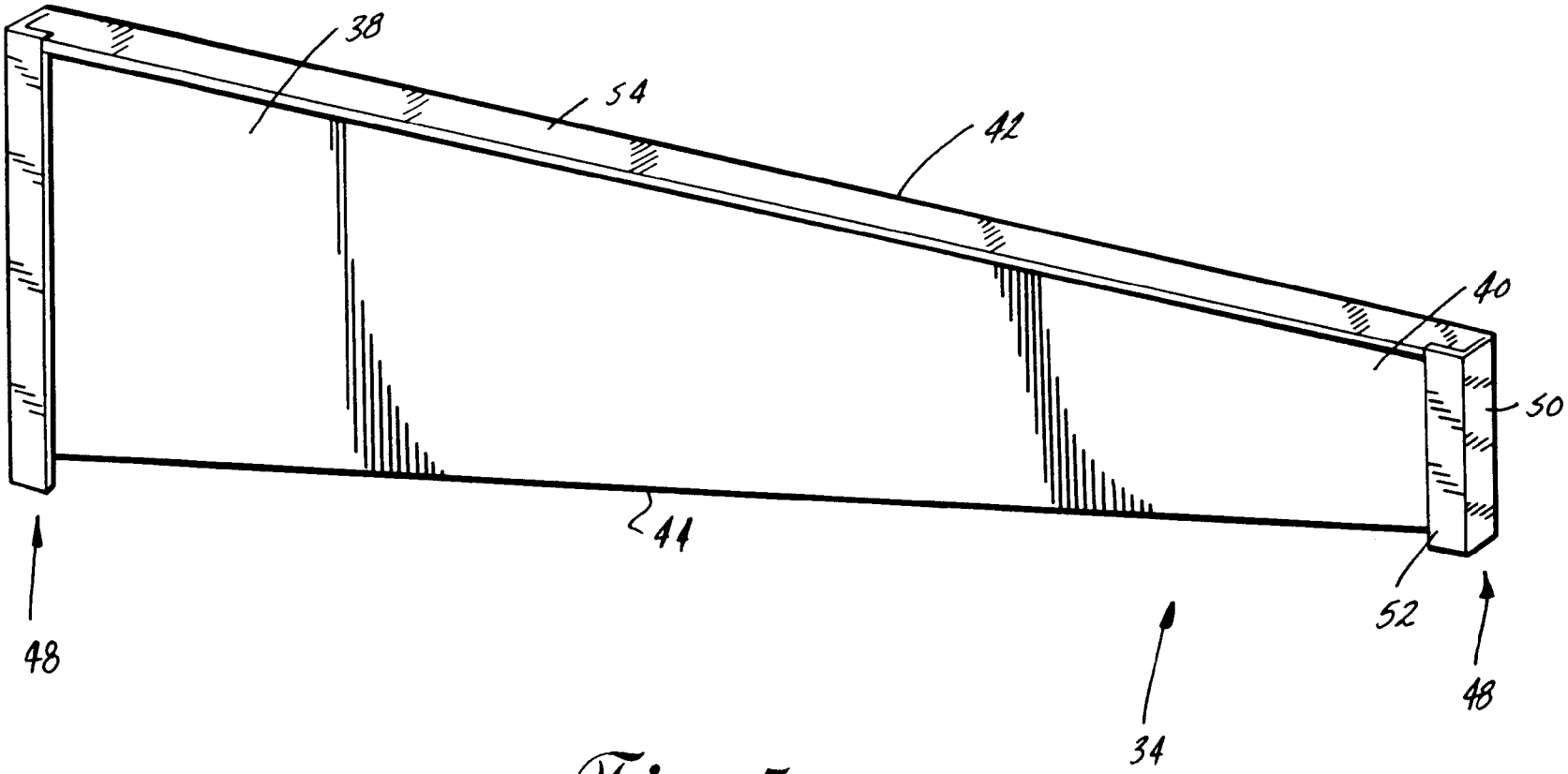
FIG. 5 is a perspective view of the adjustable flow restriction panel of FIG. 3.

Turning to FIG. 4, it can be seen that the U-shaped channels 36 are oriented along lateral edges 46 of the grease filters 28 with the open edges of the channels 36 facing each other. U-shaped return flanges 48 are provided at the first and second ends 38 and 40 of the panel 34. Each flange 48 comprises a lip 50 extending normal to the panel 34 and a second lip 52 extending from the first lip parallel to the panel 34. (See also FIG. 5). The flanges 48 are designed to slide freely within the channels 36. Some form of locking mechanism, such as a lock nut or pin (not shown), is preferably provided for holding the panel 34 at a desired location within the channels 36.

In the orientation shown in FIG. 4, the panel 34 nearly abuts the grease filters 28, whereby air cannot flow through the grease filters 28 adjacent to the panel 34 and then travel parallel to the panel 34 and out through the exhaust duct 26. However, if the panel 34 is reversed within the channels 36, the panel 34 will be spaced apart slightly from the grease filter 28. With the panel 34 in this orientation and to prevent air from flowing through the grease filter 28 adjacent to the panel 34 and travelling parallel to the panel 34 to escape into the plenum 24 and out through the exhaust 26, a lip 54 is provided at the upper edge 42 of the panel 34. If desired, an additional lip (not shown) may be provided at the panel lower edge 44.

In a typical kitchen installation, the kitchen equipment will be oriented underneath the exhaust hood 10. After the kitchen equipment has been placed into a desired arrangement, the flow adjusting mechanism 32 is adjusted to provide appropriate exhaust quantities across the width of the exhaust hood 10. For instance, the panel 34 will be inserted into the channel 36 with its narrower second end 40 positioned above the more active producers of smoke, fumes and grease such as the broilers and fryers. Then, the panel 34 will be moved within the channels to a desired location to produce an appropriate total volume of exhaust flow through the hood 10. Thus, the flow control mechanism 32 provides not only control over the gross volume of air exhausted through the exhaust hood 10 but also the lateral distribution of the exhaust air across the width of the exhaust hood 10.

If an even distribution of air is desired across the exhaust hood 10, the exhaust duct 26 can be located adjacent to one side 18 of the exhaust hood 10 and the wider first end 38 of the panel 34 can be located at that same side. Thus, more flow restriction will be placed in front of the grease filters 28 adjacent to the exhaust duct 26 and less flow restriction placed in front of the grease filters 28 away from the exhaust duct 26 to provide an even distribution of air exhausted through the grease filters laterally across the width of the exhaust hood 10.

Figure 3:
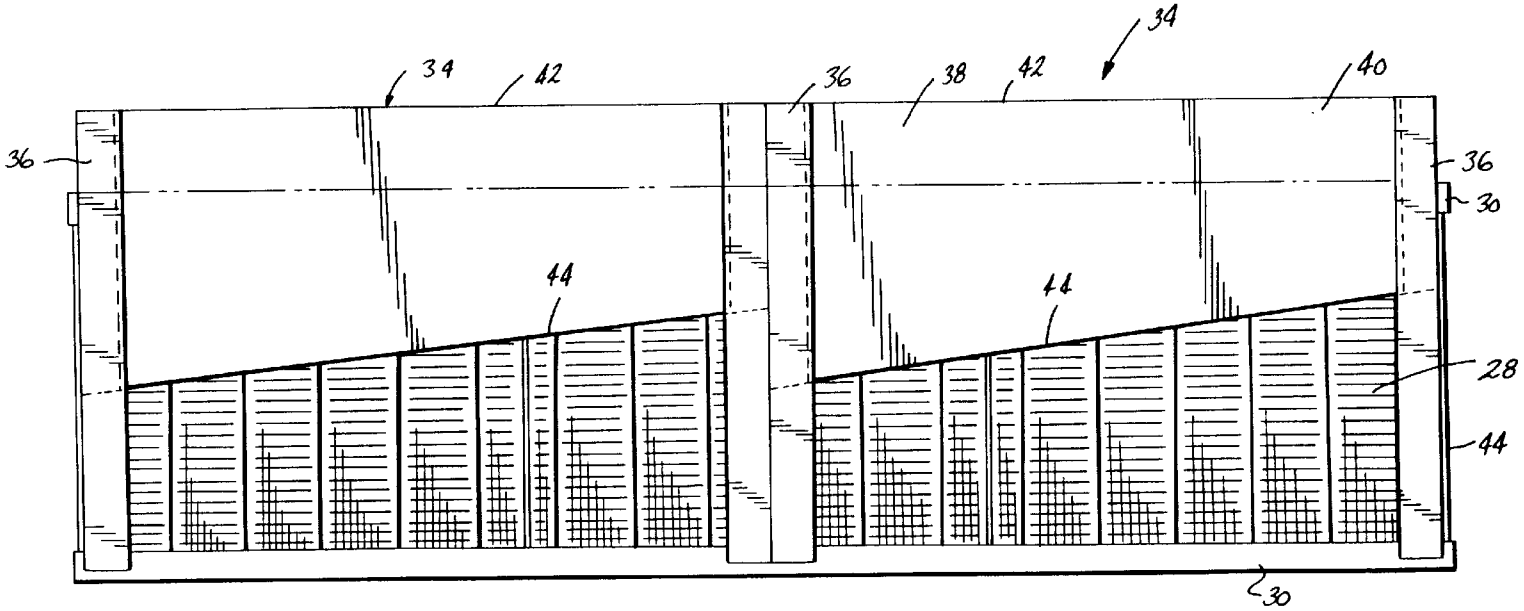
FIG. 3 is a sectional view of the hood of FIG. 1 taken along line 3—3 of FIG. 2 and illustrating grease baffles and an adjustable flow restriction panel according to the invention.

As shown in FIG. 3, multiple panels 34 are preferably provided in side-by-side orientation for increased flexibility in adjusting the air distribution within the exhaust hood 10. Various orientations of side-by-side panels can be provided. For instance, two panels 34 can be provided with their wide first ends 38 located in a central section of the hood 10 and their narrower second ends 40 located adjacent to the sides of the hoods 18. In this orientation, with an exhaust duct 26 located in the center of the hood 10, an even distribution of air can be provided as the greater suction effect in the center of the hood due to the location of the exhaust duct would be negated by the greater blockage of the grease filters 28 in the center of the hood. Each panel 34 could be independently adjusted. Also, multiple panels can be provided, one behind the other.

By varying the angle of the lower edge 44 relative to the upper edge 42, a greater degree of flow restriction is provided on one side of the hood versus the other. Also, other shapes may be provided for the panel 34. For instance, the lower edge 44 can be made parallel the upper edge 42 with one of the upper or lower edges 42 or 44 provided with a discontinuity to vary the height (distance between the upper and lower edges 42 and 44) of the panel 34 from one end 38 to the other 40. When employed in a kitchen, the exhaust hood 10 could be provided with separate panels 34 in side-by-side relation corresponding to each piece of kitchen equipment located beneath the exhaust hood 10. However, for most applications, an arrangement having one or two panels 34 shaped as illustrated in FIG. 3 provides ample adjustability of flow distribution across the exhaust hood 10 with a simple and uncomplicated structure.

Figure 6:
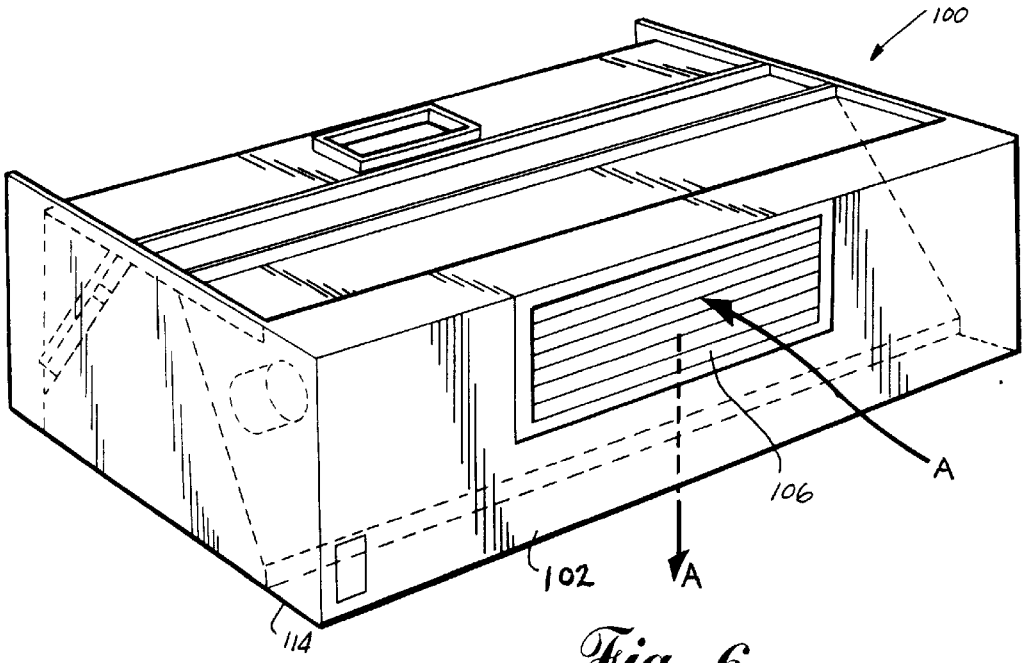
FIG. 6 is a partial sectional perspective view of a second embodiment of a hood according to the invention.
Figure 7:
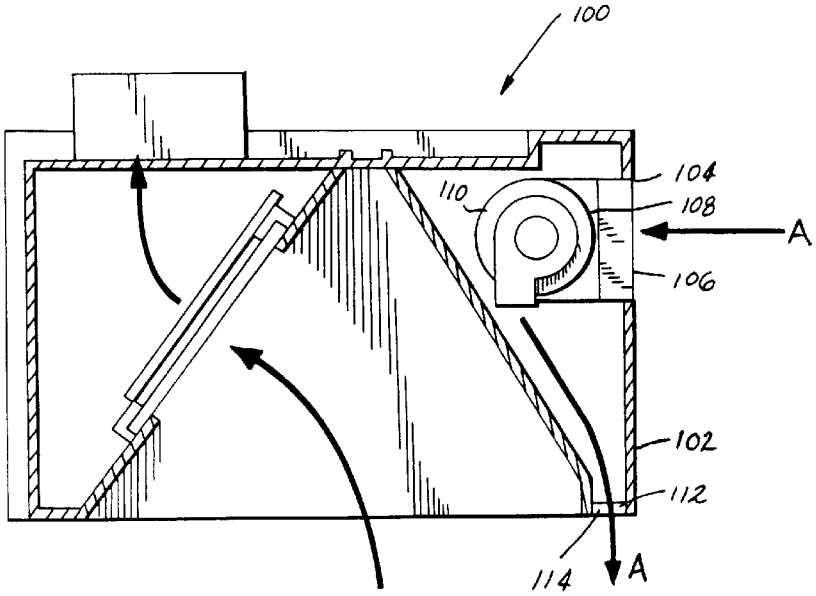
FIG. 7 is a cross sectional view of the hood taken along line 7—7 of FIG. 6.

Turning now to FIGS. 6 and 7, a second embodiment of the invention includes a hood 100, similar in all salient respects to the hood 10 of FIG. 1, but with an additional flow path A to create an air curtain across the front of the hood with make-up air directly from the space adjacent the hood. A front panel 102 of the hood 100 has an opening 104 which is covered by a protective louver 106. A flow-through fan 108, directly behind the opening, draws air from adjacent the hood, through the opening, 104 and into a plenum 110 at a forward portion of the hood.

A diffuser opening 112, preferably extending from one side of the hood to the other, is disposed at the front edge of a lower panel 114 of the hood. Air in the plenum 110 is forced by the fan 108 out through the diffuser opening 112 to create a curtain of air beneath the front panel 102 of the hood. When the hood 100 is installed and operated in the kitchen, the air curtain is created solely from make-up air which is already tempered since it is drawn from adjacent the hood.

The air is expelled, not to a separate receiver, but directly through the hood. Hence, it is not a complete air curtain in the sense of fully sealing the front of the adjoining work area beneath the hood, but rather curtains primarily the uppermost space beneath the hood. However, since warm, smoke and grease-laden air generally rises, a partial air curtain effectively seals the contaminated air from the kitchen area and helps exhaust it through the hood.

While the invention has been particularly described in connection with certain specific embodiments thereof, it is to be understood that this is by way of illustration and not of limitation, and the scope of the appended claims should be construed as broadly as the prior art will permit.

What is claimed is:

1. An exhaust hood comprising:

a housing having an open underside, a grease filter cooperating with the housing to define an exhaust plenum therebetween and an exhaust flow path through the grease filter, a shutter panel mounted adjacent to the grease filter and having a first end and a second end opposite the first end, the height of the shutter panel varying from the first end to the second end, and slidable into the flow path wherein the distribution of air across the open underside is adjustable without decreasing the volume of air, the amount of flow restriction effected by the shutter panel varying between the ends, an intake plenum at a front portion of the housing in direct communication with space adjacent the housing, with diffuser opening at a front portion of the housing facing downwardly to define an intake flow path, and a fan mounted to the housing for drawing air from adjacent the housing into the intake plenum and out the diffuser opening along the intake flow path which is then exhausted along the exhaust flow path.

2. An exhaust hood according to claim 1, wherein a first plane is defined by the grease filter and the shutter panel is slidable in a second plane parallel to the first plane.

3. An exhaust hood according to claim 2, including a pair of opposed channel members mounted in the second plane, the shutter panel having a first end and a second end opposite from the first end, each of the ends having a flange slidably received within a respective one of the channel members.

4. An exhaust hood according to claim 2, wherein the second plane is disposed above the first plane.

5. An exhaust hood according to claim 3, wherein the flanges are similarly shaped, whereby either of the flanges is receivable within each of the channels and the shutter panel is thereby reversible.

6. An exhaust hood according to claim 1, wherein the shutter panel has an upper edge and a lower edge opposite the upper edge, the edges extending between the ends of the panel means and converging.

7. An exhaust hood according to claim 1, wherein the height of the shutter panel tapers uniformly from the first end to the second end.

8. An exhaust hood according to claim 1, wherein the height of the shutter panel at the first end is approximately twice the height at the second end.

9. An exhaust hood according to claim 1, including a pair of opposed channel members mounted in the second plane, each of the ends of the shutter panel having a flange slidably received within a respective one of the channel members.

10. An exhaust hood according to claim 9, wherein the flanges are similarly shaped, whereby either of the flanges is receivable within each of the channels and the shutter panel is thereby reversible.

11. An exhaust hood according to claim 1, including a second shutter panel mounted adjacent to the grease filter for sliding movement in the second plane into the flow path, the second shutter panel being disposed horizontally adjacent to said one shutter panel.

12. An exhaust hood according to claim 11, wherein the configuration of the second shutter panel is substantially similar to that of said one shutter panel.

13. In an exhaust hood comprising a housing having an open underside and a grease filter defining a first plane, the housing and grease filter cooperating to define an exhaust plenum therebetween and an exhaust flow path through the grease filter, the housing further having an intake plenum at a front portion thereof, an intake opening, and a diffuser opening to direct air from the intake plenum downwardly across the front of the space beneath the open underside, the improvement comprising:

the intake opening being in direct communication with the space adjacent to and in front of the hood, a fan mounted in communication with the intake opening to draw air into the intake plenum whereby air from the intake plenum is forced out the diffuser opening to create at least a partial air curtain beneath the hood and across the front of the space beneath the open underside, and a shutter panel adjacent to the grease filter, the shutter panel defining a second plane parallel to the first plane, the shutter panel being slidable in the second plane into the exhaust flow path, the shutter panel having an upper edge and a lower edge opposite the upper edge, the edges extending between the ends of the panel and converging.

14. In an exhaust hood comprising a housing having an open underside and a grease filter defining a first plane, the housing and grease filter cooperating to define an exhaust plenum therebetween and an exhaust flow path through the grease filter, the housing further having an intake plenum at a front portion thereof, an intake opening, and a diffuser opening to direct air from the intake plenum downwardly across the front of the space beneath the open underside, the improvement comprising:

the intake opening being in direct communication with the space adjacent to and in front of the hood, a fan mounted in communication with the intake opening to draw air into the intake plenum whereby air from the intake plenum is forced out the diffuser opening to create at least a partial air curtain beneath the hood and across the front of the space beneath the open underside, a shutter panel adjacent to the grease filter, the shutter panel defining a second plane parallel to the first plane, the shutter panel being slidable in the second plane into the exhaust flow path, and a pair of opposed channel members mounted in the second plane, the shutter panel having, a first end and a second end opposite from the first end, each of the ends having a flange slidably received within a respective one of the channel members, the height of the shutter panel tapering uniformly from the first end to the second end.

15. In an exhaust hood comprising a housing having an open underside and a grease filter defining a first plane, the housing and grease filter cooperating to define an exhaust plenum therebetween and an exhaust flow path through the grease filter, the housing further having an intake plenum at a front portion thereof, an intake opening, and a diffuser opening to direct air from the intake plenum downwardly across the front of the space beneath the open underside, the improvement comprising:

the intake opening being in direct communication with the space adjacent to and in front of the hood, a fan mounted in communication with the intake opening to draw air into the intake plenum whereby air from the intake plenum is forced out the diffuser opening to create at least a partial air curtain beneath the hood and across the front of the space beneath the open underside, a shutter panel adjacent to the grease filter, the shutter panel defining a second plane parallel to the first plane, the shutter panel being slidable in the second plane into the exhaust flow path, and a pair of opposed channel members mounted in the second plane, the shutter panel having a first end and a second end opposite from the first end, each of the ends having a flange slidably received within a respective one of the channel members, the height of the shutter panel at the first end being approximately twice the height at the second end.

* * * * *